US008059284B2

(12) United States Patent
Ryan et al.

(10) Patent No.: US 8,059,284 B2
(45) Date of Patent: Nov. 15, 2011

(54) AUTOMATED BOOKLET MAKER

(75) Inventors: Jeffrey W. Ryan, Knebworth (GB); Jonathan Dibling, Essex (GB)

(73) Assignee: Xerox Corporation, Norwalk, CT (US)

( * ) Notice: Subject to any disclaimer, the term of this patent is extended or adjusted under 35 U.S.C. 154(b) by 641 days.

(21) Appl. No.: 12/261,602

(22) Filed: Oct. 30, 2008

(65) Prior Publication Data

US 2010/0110463 A1 May 6, 2010

(51) Int. Cl.
*H04N 1/04* (2006.01)

(52) U.S. Cl. ..... 358/1.12; 358/488; 358/492; 358/493

(58) Field of Classification Search ..... 358/1.12, 358/488, 492, 493, 497
See application file for complete search history.

(56) References Cited

U.S. PATENT DOCUMENTS 5,871,323 A * 2/1999 Clark ..... 412/4
6,799,759 B1 10/2004 McNamara et al.
6,939,283 B2 9/2005 Sparano et al.
6,981,938 B2 1/2006 Ruthenberg et al.
7,431,274 B2 * 10/2008 Kushida et al. ..... 270/37
7,537,558 B2 * 5/2009 Vono et al. ..... 493/443

* cited by examiner

*Primary Examiner* — Houshang Safaipour
(74) *Attorney, Agent, or Firm* — Hoffman & Baron, LLP

(57) ABSTRACT

An apparatus for transporting processed sheets within a printing device. The apparatus includes a compiler including a slot for receiving the processed sheets. The slot is defined at least in part by a paper guide. An elevator is in operative communication with the compiler. The elevator includes a stop for supporting the processed sheets and a drive mechanism for moving the stop and processed sheets supported thereby between a plurality of positions. The stop has a first position for initially receiving the processed sheets. The stop is movable from the first position in a generally upward direction to a second position for breaking adhesion between a processed sheet and the paper guide. The stop is movable in a generally downward direction from the second position to a third position.

20 Claims, 6 Drawing Sheets

AUTOMATED BOOKLET MAKER

BACKGROUND

1. Technical Field

The present disclosure relates to automated booklet makers, in which printed sheets are formed into a booklet, and more particularly, to transporting the printed sheets in a booklet maker.

2. Brief Discussion of Related Art

Booklet makers are well-known devices for forming folded booklets which are stapled along the crease thereof. It is becoming common to include booklet makers in conjunction with a finisher module of an office-range printer. The word "printer" as used herein encompasses any apparatus, such as a digital copier, bookmaking machine, facsimile machine, multifunction machine, etc. which performs a print outputting function for any purpose. In basic form, a booklet maker includes a slot for accumulating processed sheets, as would be produced by a printer. The accumulated sheets, forming the pages of a booklet, are positioned within the stack so that a stapler mechanism and complementary anvil can staple the stack precisely along the intended crease line. The creased and stapled sheet sets are then pushed, by a blade, completely through crease rollers, to form the final main fold in the finished booklet. The finished booklets are then accumulated in a tray downstream of the crease rollers.

When the processed sheets are sitting in the slot awaiting the remaining sheets to be printed, adhesion may occur between the sheets and a portion of a paper guide forming the slot. When the sheets are transported for further finishing, the adhesion prevents the sheets from moving uniformly to the desired finishing position. This results in an improperly assembled booklet and/or jamming.

Accordingly, it would be desirable to provide a booklet maker which reliably and uniformly transports the processed sheets to produce a quality booklet.

SUMMARY

According to aspects illustrated herein, there is provided an apparatus for transporting processed sheets within a printing device. The apparatus includes a compiler including a slot for receiving the processed sheets. The slot is defined at least in part by a paper guide. An elevator is in operative communication with the compiler. The elevator includes a stop for supporting the processed sheets and a drive mechanism for moving the stop and processed sheets supported thereby between a plurality of positions. The stop has a first position for initially receiving the processed sheets. The stop is movable from the first position in a generally upward direction to a second position for breaking adhesion between a processed sheet and the paper guide. The stop is movable in a generally downward direction from the second position to a third position.

According to other aspects illustrated herein, there is provided a booklet maker including a compiler for collecting processed sheets. The compiler includes a paper guide. An elevator includes a stop for supporting the processed sheets and a drive mechanism for transporting the stop and processed sheets supported thereby to a plurality of positions. A stapler for stapling the processed sheets, and a creasing assembly for creasing the sheets are provided. The stop is in operative communication with the compiler. The stop has a first position for receiving the processed sheets wherein at least one of the sheets is in contact with the paper guide. The stop is movable in a first direction to a second position displaced from the first position. The stop is movable in a second direction opposite the first direction to a third position to locate the processed sheets for stapling by the stapler.

According to still other aspects illustrated herein, there is provided a method of breaking adhesion between a sheet and a paper guide in a booklet maker comprising:

i. positioning a sheet supporting stop at a first position;

ii. receiving a plurality of processed sheets on the stop disposed in the first position wherein at least one of the sheet comes in contact with the paper guide;

iii. prior to stapling of the sheets together, moving the stop in a first direction relative to the paper guide to a second position thereby breaking adhesion between the at least one sheet and the paper guide; and iv. moving the stop in a second direction to a third position, wherein the second direction is generally opposite of the first direction.

DETAILED DESCRIPTION

Exemplary embodiments include a booklet maker including a compiler for collecting printed media such as sheets. The booklet maker can include a movable elevator for transporting the media to various positions to form a booklet.

As used herein, "printing device" refers to any apparatus, such as a digital copier, bookmaking machine, facsimile machine, multifunction machine, etc. which performs a print outputting function for any purpose.

As used herein, "processed sheets" refers to sheets which have been acted upon in some manner by a printing device.

As used herein, "compiler" refers to a device or devices for receiving and collecting processed sheets.

A used herein, "paper guide" refers to a structure which engages sheets and directs, guides or supports the sheets.

As used herein, "elevator" refers to a device causing the movement of sheets.

As used herein, "stop" refers to a part of the elevator on which the sheets are supported. For example, the stop may support the edges of the sheets.

As used herein, "booklet maker" refers to a portion of a printing device including one or more devices that form booklets from processed media.

As used herein, "stapler" refers to a device for joining together sheets using a fastening device such as a staple.

As used herein, "creasing assembly" refers to one or more devices cooperating to fold processed sheets. Such devices may include, for example, crease rollers and a crease blade.

Figure 1:
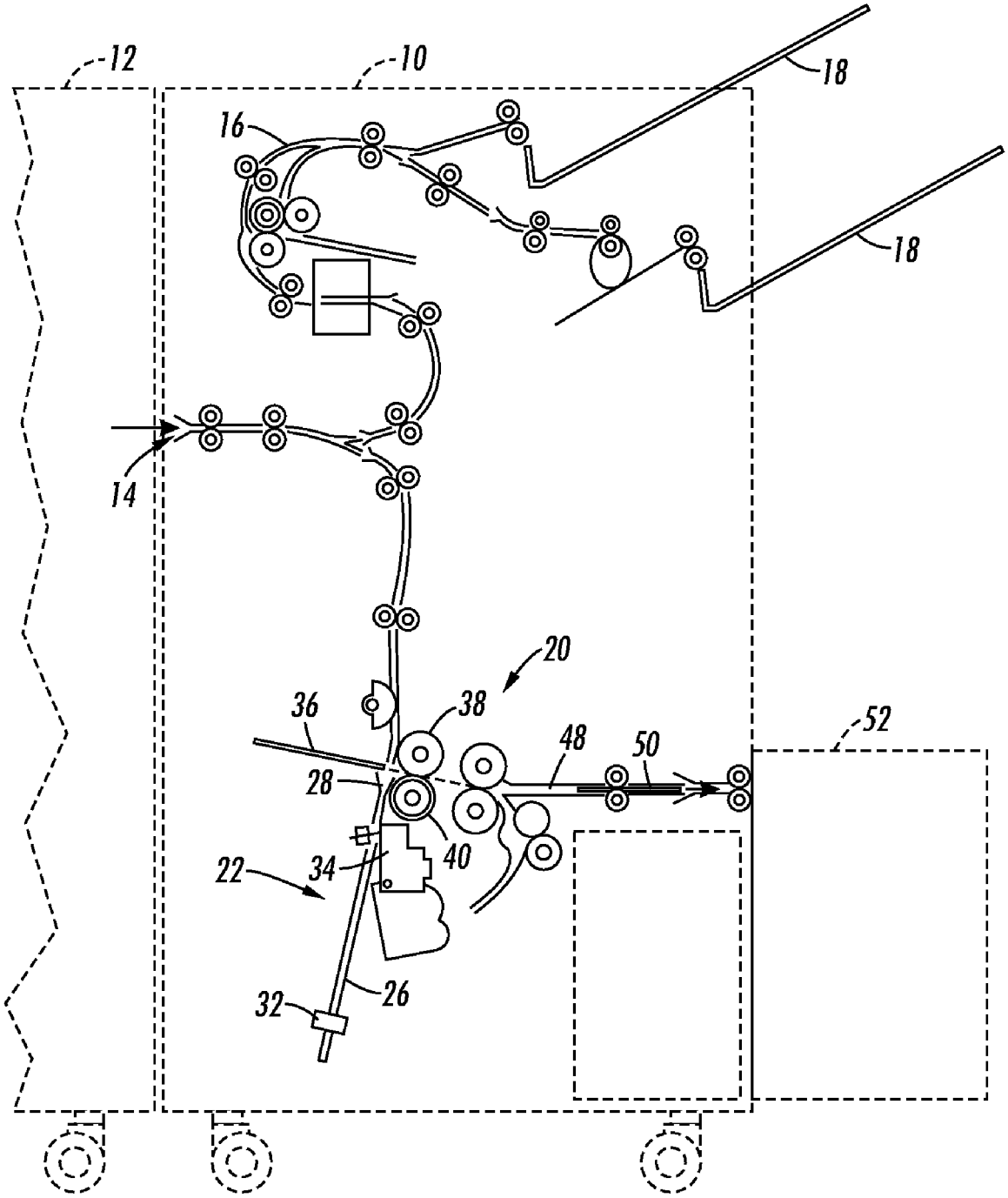
FIG. 1 is a simplified elevational view of a finisher module as would be used with a printer.

FIG. 1 is a simplified elevational view of a finisher module, generally indicated as 10, including a booklet maker, as would be used with an office-range printer. Printed sheets from the printer 12 are accepted in an entry port 14. Depending on the specific design of finisher module 10, there may be numerous paths such as 16 and numerous output trays 18 for print sheets, corresponding to different desired actions, such as stapling, hole-punching and C- or Z-folding. It is to be understood that the various rollers and other devices which contact and handle sheets within finisher module 10 are driven by various motors, solenoids and other electromechanical devices (not shown), under a control system, such as including a microprocessor (not shown), within the finisher module 10, printer 12, or elsewhere, in a manner generally familiar in the art. For present purposes what is of interest is the booklet maker generally indicated as 20.

Figure 2:
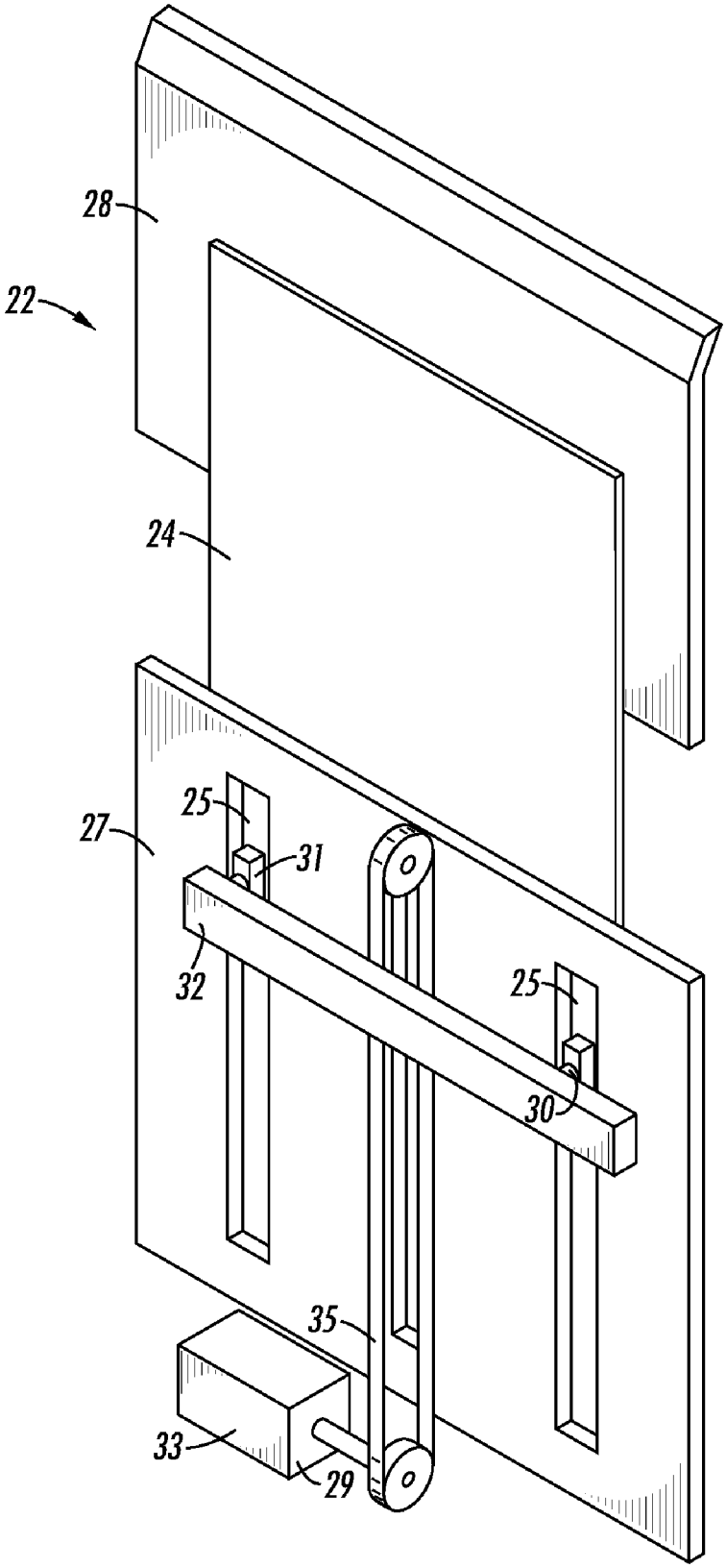
FIG. 2 is a perspective view which diagrammatically represents a compiler portion of the finisher module.

With reference to FIGS. 1 and 2, booklet maker 20 includes a compiler 22 which receives from the printer 12 processed sheets 24 that may each have four page images thereon, for eventual folding into pages of the booklet. The compiler 22 includes a slot 26 formed in part by a paper guide 28. Paper guide 28 may be a generally planar member which guides the movement of the processed sheets 24 and provides support to them. Lower portion of the slot 26 includes a sheet elevator 32 having a stop 30 which supports the leading edge of the sheets 24. The stop 30 may include projecting members 31 which ride in grooves 25 in a support plate 27. The sheet elevator 32 further includes a drive mechanism 33 operatively connected to the stop 30. The drive mechanism 33 may include a motor 29 and belt 35. The belt 35 extends between the motor 29 and member supporting the stop projecting members 31. The motor 29 may be operatively connected to a controller which provides signals which cause the stop 30 to move in a desired manner. The instructions for controlling the drive mechanism 33 may be incorporated in computer software as encoded instructions which may be executed in a central processing unit of the controller. The elevator 32 moves the stop 30, and the sheets supported thereby, to different positions in the finisher module. The stop's movement may be translational along a linear axis which is generally vertically oriented to permit movement in the upward and downward direction. The stop 30, and sheets supported thereby, may be moved to different positions in order to permit various finishing functions to take place.

Figure 3:
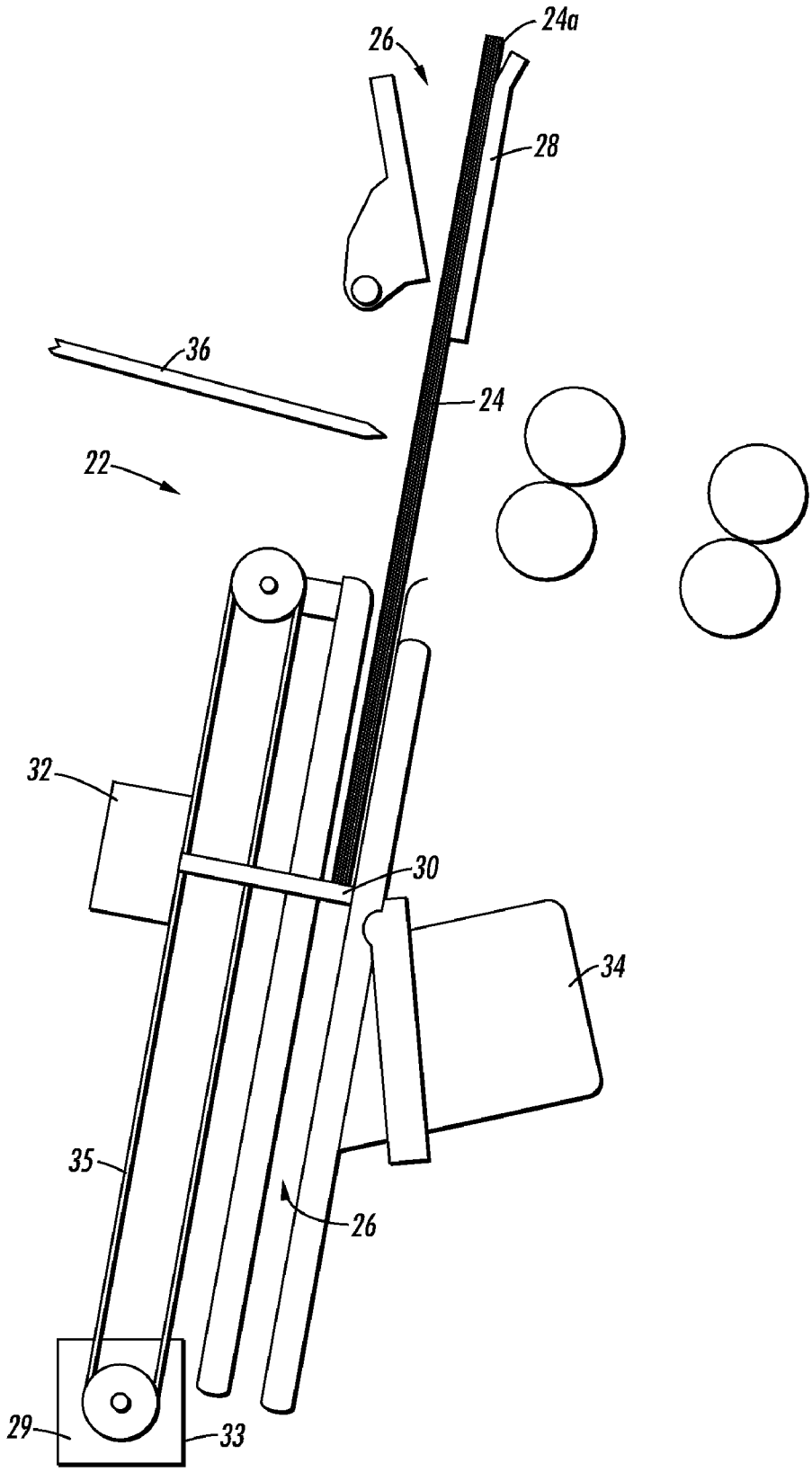
FIG. 3 is an elevational side view which diagrammatically represents the compiler with a sheet elevator shown in the receiving position.

As the sheets are printed outputted from the printer 12, they are transported to the compiler 22 with the stop 30 located at a first collecting position as shown in FIG. 3. The actual position of the stop 30 may be determined by the size of the sheet being processed so that the sheets are properly accommodated within the compiler 22. In this first position, an outer sheet 24*a* of the sheet set 24 rests against the paper guide 28. The stop 30 remains in the first position until all of the sheets to form a desired booklet are accumulated.

If the sheet set 24 is to be stapled after the printing is completed, the sheet set is moved downwardly by elevator 32 to a stapling position. As the stop 30 is lowered by the drive mechanism 33, the force of gravity moves the sheets downwardly to follow the stop. However, material, such as ink applied to the sheets during the printing process, may have a tendency to adhere at least one of the sheets, e.g. outer sheet 24*a*, to the paper guide 28. When such adhesion occurs, one or more of the sheets may not follow the stop 30 down, and therefore, all the sheets of the sheet set 24 would not be in the proper position for stapling or other finishing process.

Figure 4:
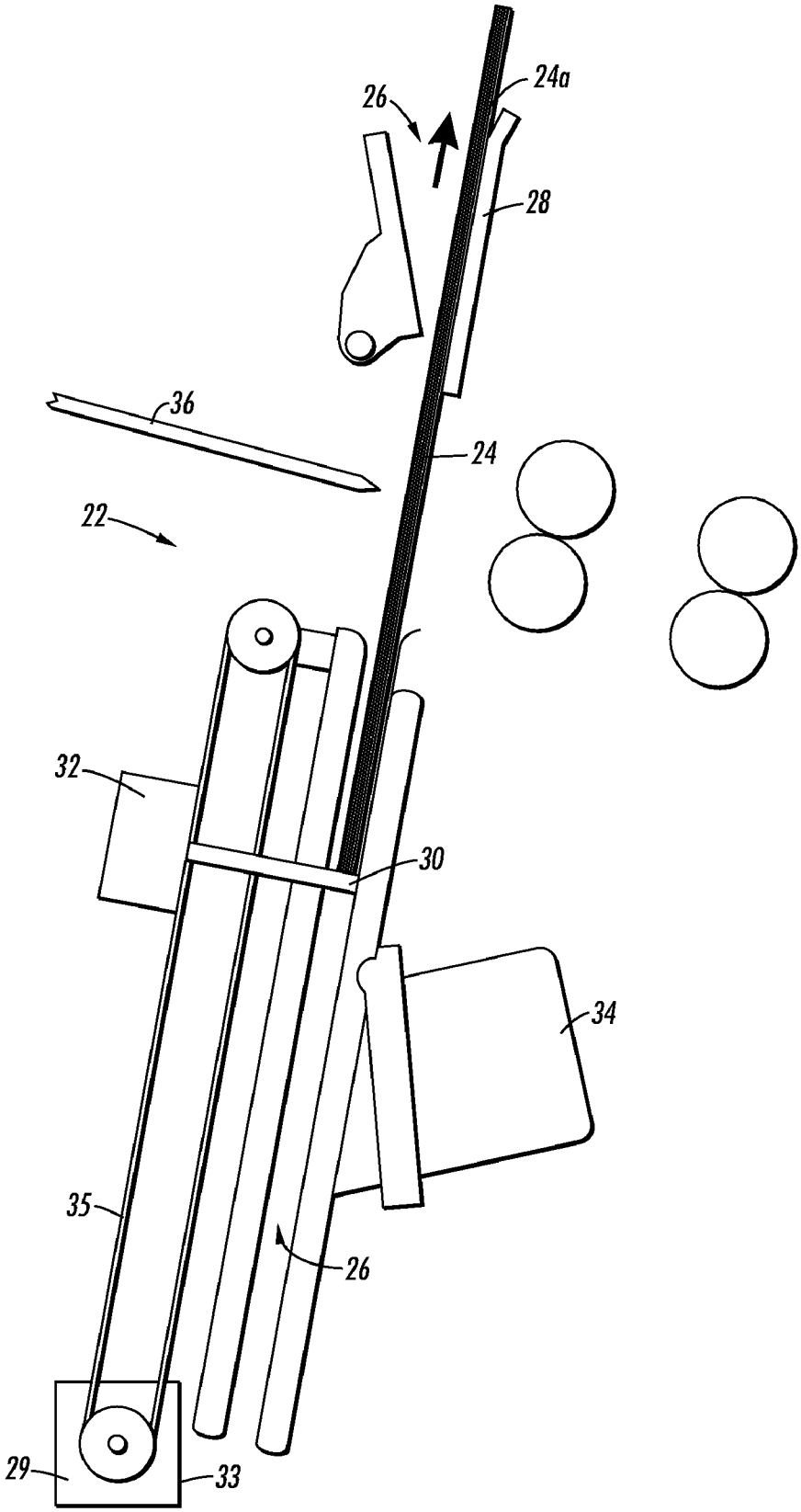
FIG. 4 is an elevational side view which diagrammatically represents the compiler with a sheet elevator shown in the adhesion breaking position.

In order to break such adhesion to the paper guide 28, an additional movement of the stop 30 is employed. Before moving the sheets downwardly from the first collecting position, the controller sends a signal to the elevator 32 to move the stop 30 upwardly to a second position as shown in FIG. 4. The upward movement of the stop 30 pushes the sheet set 24 upwardly and breaks any adhesion between the sheets 24 and the paper guide 28. The sheet set 24 may then move freely past the paper guide 28. The amount of displacement may be about 10 mm. However, displacements of about 1 mm to 25 mm may be used. This amount of displacement between the first and second positions may be independent of the size of the sheets. It is further contemplated that prior to any downward movement of the stop 30, the stop may be first moved upwardly momentarily in order to overcome adhesion issues between the sheets and elements which support or guide the sheets. The second position may be non-processing position in that the sheets are not acted upon or processed while in that position.

Figure 5:
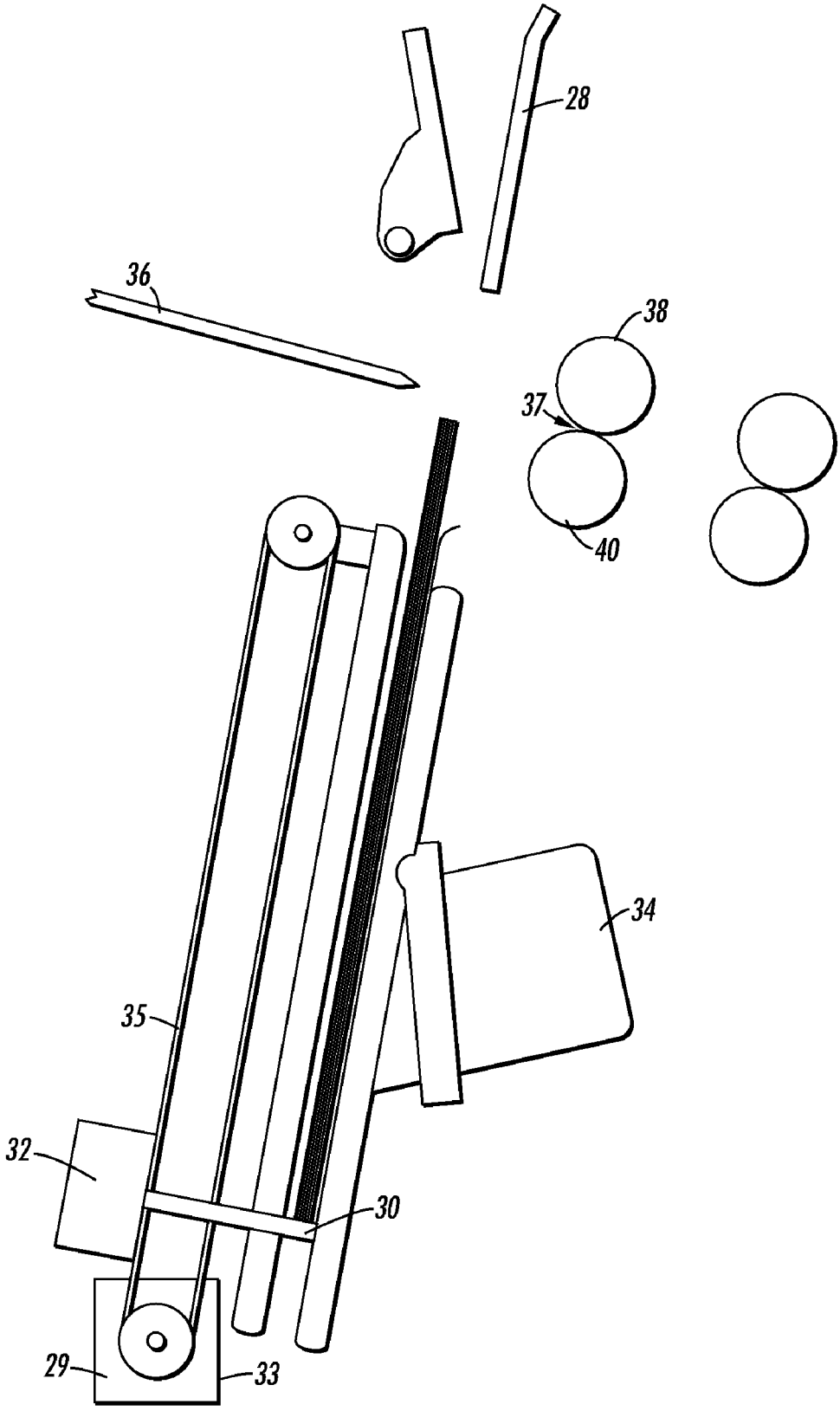
FIG. 5 is an elevational side view which diagrammatically represents the compiler with a sheet elevator shown in a stapling position.

When the stop 30 reaches the second position, the elevator 32 may then move the stop 30 downwardly to a third position for stapling as shown in FIG. 5. With the adhesion between the sheets and the guide broken, all the sheets of sheet set 24 can move under the force of gravity and follow the stop 30 downward to the third position. In this position, stapler 34 may staple the sheets along their midline which corresponds to the eventual crease of the finished booklet. In order to hold sheets of a given size at the desired level relative to the stapler 34, the stop 30 may be moved to the appropriate location. Accordingly, the amount of displacement of the stop 30 between the second and third position may be dependant on the size of the sheets.

Figure 6:
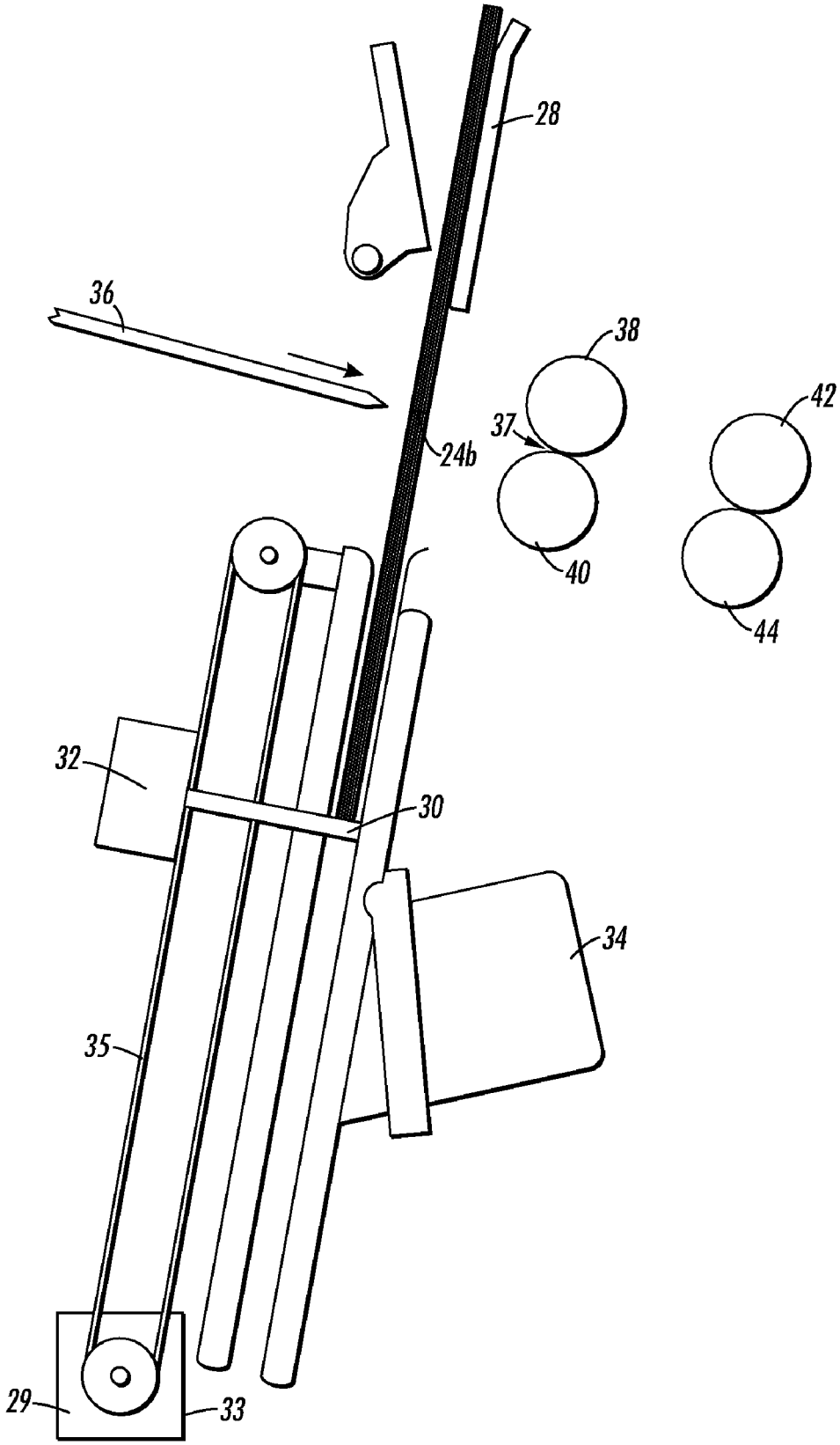
FIG. 6 is an elevational side view which diagrammatically represents the compiler with a sheet elevator shown in a creasing position.

With reference to FIGS. 1 and 6, after the stapling is completed, elevator 32 moves the stop 30 from its third position to a fourth position, where the midpoint of the sheets is disposed between a crease blade 36 and a nip 37 formed by the first set of crease rollers 38 and 40. This movement to the fourth position may be generally upwardly. The action of blade 36 and crease rollers 38 and 40 performs the initial folding and creasing of the sheets into a booklet. Blade 36 contacts the sheet set 24 along the stapled midpoint 24*b* thereof, and bends the sheet set toward the nip of crease rollers 38 and 40. A second set of crease rollers 42 and 44 are disposed downstream of the first set of crease rollers. The second set of crease rollers form a sharp crease to form the finished booklet. The finished booklets 48 are then conducted along path 50 and collected in a tray 52 (FIG. 1).

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. An apparatus for transporting processed sheets within a printing device comprising:

a compiler including a slot for receiving the processed sheets; the slot being defined at least in part by a paper guide;

an elevator in operative communication with the compiler, the elevator including a stop for supporting the processed sheets and a drive mechanism for moving the stop and processed sheets supported thereby between a plurality of positions; and the stop having a first position for initially receiving the processed sheets, the stop being movable from the first position in a generally upward direction to a second position for breaking adhesion between a processed sheet and the paper guide, the stop being movable in a generally downward direction from the second position to a third position.

2. The apparatus as defined in claim 1, wherein movement to the second position is relative to the paper guide.

3. The apparatus as defined in claim 1, wherein the second position is a non-processing position.

4. The apparatus as defined in claim 1, wherein a first stop displacement between the first and second position is independent of a size of the sheets.

5. The apparatus as defined in claim 4, wherein a second stop displacement between the second position and the third position is dependent on a size of the sheets.

6. The apparatus as defined in claim 1, wherein the stop moves along a generally vertical axis.

7. The apparatus as defined in claim 1, wherein the displacement between the first and second positions is in the range of about 1 mm to 25 mm.

8. The apparatus as defined in claim 7, wherein the displacement between the first and second positions is about 10 mm.

9. The apparatus as defined in claim 1, wherein the stop is movable generally upwardly to a fourth position displaced from the third position.

10. A booklet maker comprising:

a compiler for collecting processed sheets, the compiler including a paper guide;

an elevator including a stop for supporting the processed sheets and a drive mechanism for transporting the stop and processed sheets supported thereby to a plurality of positions;

a stapler for stapling the processed sheets;

a creasing assembly for creasing the sheets; and the stop being in operative communication with the compiler, the stop having a first position for receiving the processed sheets wherein at least one of the sheets is in contact with the paper guide, the stop being movable in a first direction to a second position displaced from the first position, and the stop being movable in a second direction opposite the first direction to a third position to locate the processed sheets for stapling by the stapler.

11. The booklet maker as defined in claim 10, wherein the stop is movable to a fourth position aligned with the creasing assembly for creasing the sheets.

12. The booklet maker as defined in claim 10, wherein the stop moves along a generally vertical axis.

13. The apparatus as defined in claim 10, wherein the displacement between the first and second positions is in the range of about 1 mm to 25 mm.

14. The apparatus as defined in claim 13, wherein the displacement between the first and second positions is about 10 mm.

15. A method of breaking adhesion between a sheet and a paper guide in a booklet maker comprising:

positioning a sheet supporting stop at a first position;

receiving a plurality of processed sheets on the stop disposed in the first position wherein at least one of the sheets comes in contact with the paper guide;

prior to stapling of the sheets together, moving the stop in a first direction relative to the paper guide to a second position thereby breaking adhesion between the at least one sheet and the paper guide; and moving the stop in a second direction to a third position, wherein the second direction is generally opposite of the first direction.

16. The method as defined in claim 15, wherein the first direction is generally upward.

17. The method as defined in claim 16, wherein the second direction is generally downward.

18. The method as defined in claim 15, including stapling the processed sheets in the third position.

19. The method as defined in claim 15, including moving the stop in the first direction to the fourth position, and folding the sheets at the fourth position.

20. The method as defined in claim 15, wherein movement to the second position is in the range of about 1 to 25 mm.

* * * * *